US005545947A

United States Patent [19]

Navaroli

[11] Patent Number: 5,545,947

[45] Date of Patent: Aug. 13, 1996

[54] MULTIPLE SURFACE HIGH VOLTAGE STRUCTURE FOR A GAS DISCHARGE CLOSING SWITCH

[75] Inventor: Henry D. Navaroli, Williamsport, Pa.

[73] Assignee: Litton Systems, Inc., Beverly Hills, Calif.

[21] Appl. No.: 287,089

[22] Filed: Aug. 8, 1994

[51] Int. Cl.[6] ..... H01J 17/04

[52] U.S. Cl. ..... 313/589; 313/293; 313/592; 313/597; 313/306; 361/120

[58] Field of Search ..... 313/589, 592, 313/595, 597, 306, 326, 631, 293; 361/117, 120; 315/313, 325, 335, 340, 349, 326

[56] References Cited

U.S. PATENT DOCUMENTS

| | | | |
|---|---|---|---|
| 2,567,369 | 9/1951 | Edwards et al. | 313/592 X |
| 2,927,240 | 3/1960 | Vanderslice | 313/592 |
| 4,198,590 | 4/1980 | Harris | 313/595 X |
| 4,356,426 | 10/1982 | Menown | 313/592 |
| 4,527,090 | 7/1985 | Menown et al. | 313/592 |

FOREIGN PATENT DOCUMENTS

| | | | |
|---|---|---|---|
| 0945274 | 7/1956 | Germany | 313/589 |
| 1334527 | 10/1973 | United Kingdom . | |
| 1568506 | 5/1980 | United Kingdom . | |
| 2176934 | 1/1987 | United Kingdom . | |
| 2258757 | 2/1993 | United Kingdom . | |

*Primary Examiner*—Sandra L. O'Shea
*Assistant Examiner*—Ashok Patel
*Attorney, Agent, or Firm*—Darby & Darby, P.C.

[57] ABSTRACT

A gas discharge closing switch has a high voltage anode structure containing a plurality of surface elements facing substantially toward a cathode and spaced from each other to define gaps therebetween. In a preferred embodiment, a control electrode structure includes a surface defining an aperture corresponding to at least one of the gaps.

11 Claims, 3 Drawing Sheets

MULTIPLE SURFACE HIGH VOLTAGE STRUCTURE FOR A GAS DISCHARGE CLOSING SWITCH

BACKGROUND OF THE INVENTION

The present invention relates to a gas discharge closing switch and, more particularly, to a multiple surface high voltage structure for such a switch.

Gas discharge closing switches, such as thyratrons, are used for rapid switching of high voltage, high current signals with low power consumption. A typical thyratron has an anode connected to high voltage and a cathode held at ground potential. A control electrode or "grid" is placed between the anode and the cathode. Upon application of a positive control pulse, the control electrode closes the switch by drawing electrons from the cathode to transform gas within a housing or "envelope" of the device into a dense, conducting plasma.

In certain applications, particularly when thyratrons are used to switch pulsed high power lasers, very high currents must be switched in very short periods. Additionally, the lumped element transmission line circuits of pulsed laser systems often are characterized by mismatches that create high inverse voltage swings between the anode and the cathode. In thyratrons of conventional design, extreme inverse voltages can drive gaseous ions against the anode, thereby sputtering anode material and forming arc spots on the surface of the anode.

Attempts have been made to mitigate anode damage by providing a thyratron with an anode capable of functioning as a cathode under inverse voltage conditions. This causes current to flow opposite to the direction of normal (forward) conduction, thereby reducing the inverse voltage by means of a nondestructive glow mode. A structure of this type is disclosed in UK Patent No. 1,334,527, in which an anode is heated and contains emitter material.

Another proposed approach is to construct an anode as a hollow box having an aperture through which plasma can pass when the device operates, as disclosed in U.S. Pat. No. 4,517,090. The anode of the '090 patent is designed to store plasma within its interior during forward conduction to support current flow in a reverse direction when exposed to an inverse potential.

Although the foregoing devices reduce anode damage, they also constrain anode design. Therefore, it is desirable in many applications to provide a thyratron which permits reverse conduction without unduly restricting the shape, size and composition of its anode. In addition, it is desirable to provide a device in which plasma is stored at a plurality of locations along an anode surface to facilitate reverse conduction.

SUMMARY OF THE INVENTION

The present invention facilitates reverse conduction in a gas discharge closing switch by providing an anode made up of discrete surface elements spaced apart to define a plurality of gaps between them. Plasma is thus stored in the gaps between current pulses and is available to support reverse conduction when the thyratron is subjected to high inverse voltages. The reverse current of positive ions toward the anode extends into these gaps and does not impinge directly on the lower surface elements of the anode. In addition, it is believed that the positive ions collide with un-ionized gas species in this region before reaching the anode. This robs them of their kinetic energy and avoids anode damage.

The surface elements are preferably close enough to each other to avoid long path conduction between the control electrode and any remote portions of the surface elements. In one form, the control electrode comprises a substantially continuous transverse surface having apertures opposite to at least some of the gaps between the surface elements. Charge carriers pass through these apertures during forward and reverse conduction.

In another specific form of the invention, a relatively large number of gaps are provided between the anode surface elements to store plasma in the anode region of the device. Each of these gaps is available between forward current pulses to facilitate reverse conduction. The control electrode may then have apertures opposite some or all of the gaps and, more specifically, may be a mirror image of the anode surface elements.

Therefore, the present invention comprises: a housing for maintaining a gaseous discharge, the housing having first and second ends; an anode structure adjacent the first end of the housing, the anode structure including a plurality of surface elements facing substantially toward the second end of the housing and spaced from each other to define gaps therebetween; a cathode adjacent the second end of the housing; and a control electrode structure disposed within the housing between the anode structure and the cathode structure. The surface elements may be disposed along a common plane and may be shaped as polygons within that plane. In another embodiment, the surface elements are terminal surfaces of discrete segments of the anode structure, and the gaps are small enough to inhibit long path discharges between the control electrode and the anode structure. The discrete portions of the anode structure may be either solid or hollow. The control electrode structure preferably defines at least one aperture corresponding to at least one of the gaps of the anode structure.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
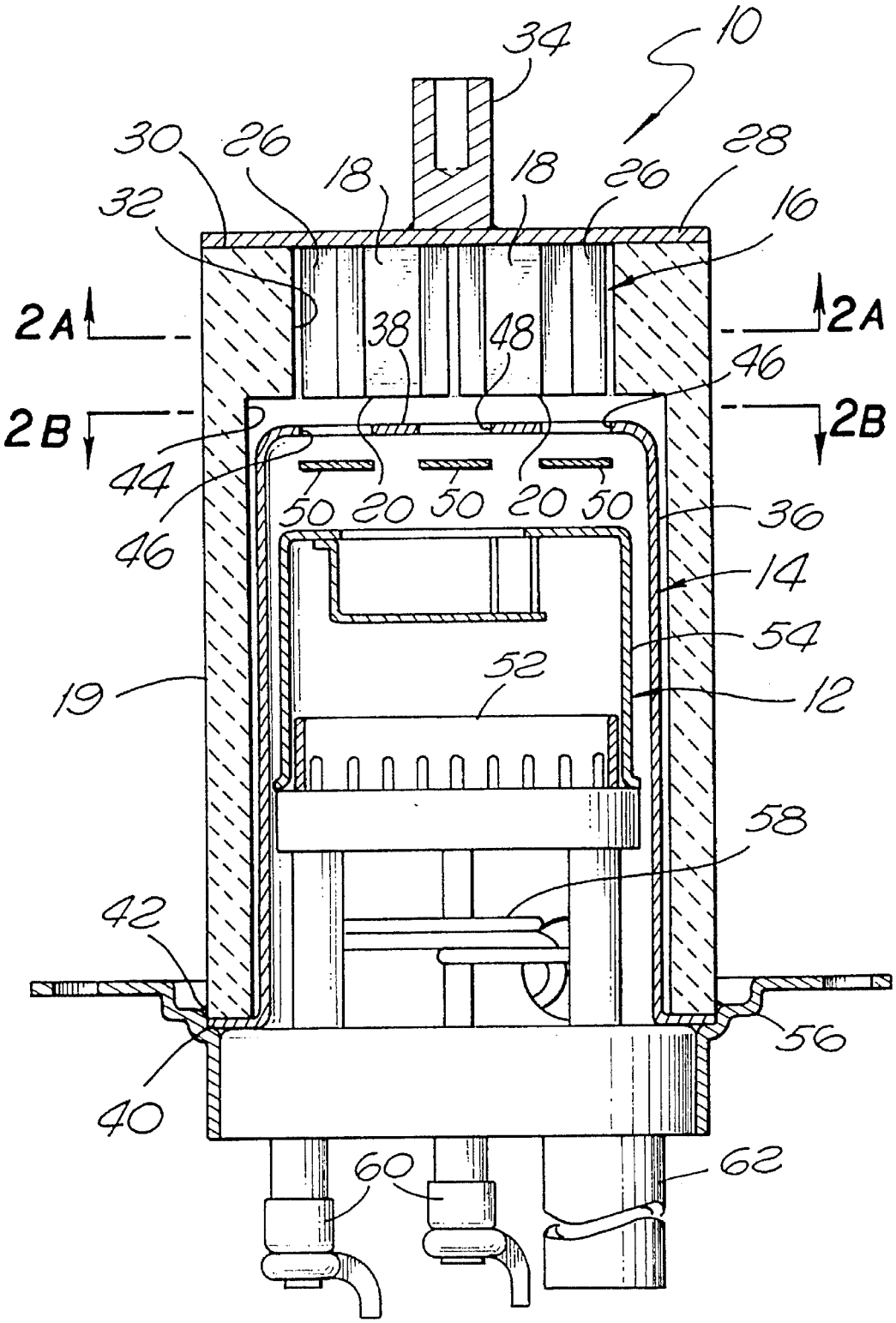
FIG. 1 is a vertical sectional view of a thyratron constructed according to one preferred embodiment of the present invention taken along its center line.

Referring now to the drawings, specifically FIG. 1, one form of gas discharge closing switch 10 constructed according to the present invention is a thyratron having a cathode structure 12, a control electrode or "grid" structure 14, and an anode structure 16 made up of a plurality of anode portions or "segments" 18. Each of these structures is affixed to a housing or "envelope" 19 which contains hydrogen or other suitable plasma-forming gas. The anode segments 18 have bottom surfaces 20 disposed substantially along a common plane and facing the control electrode 14.

The surfaces 20 of the anode segments 18 are spaced apart laterally to define a plurality of primary gaps 22 and a plurality of secondary gaps 24 between adjoining edges of the segments. The primary gaps 22, and to a lesser extent the secondary gaps 24, provide open spaces above the bottom surfaces 20. The gas in these spaces is at least partially ionized during forward conduction, in which positive current flows from the anode structure 16 to the cathode structure 12, and remains ionized for a limited time after forward conduction ceases.

The ionized gas species within the gaps 22 and 24 are available for reverse conduction under the influence of an inverse voltage, and reverse current is directed through these areas by openings in the control electrode structure 14, as described in more detail below. This causes positive ions to bypass the anode bottom surfaces 20 and impact the anode structure at their less critical side surfaces within the gaps. In addition, the volume of gas within the gaps is believed to slow the ions before they reach the anode segments, further reducing anode damage.

Figure 2A:
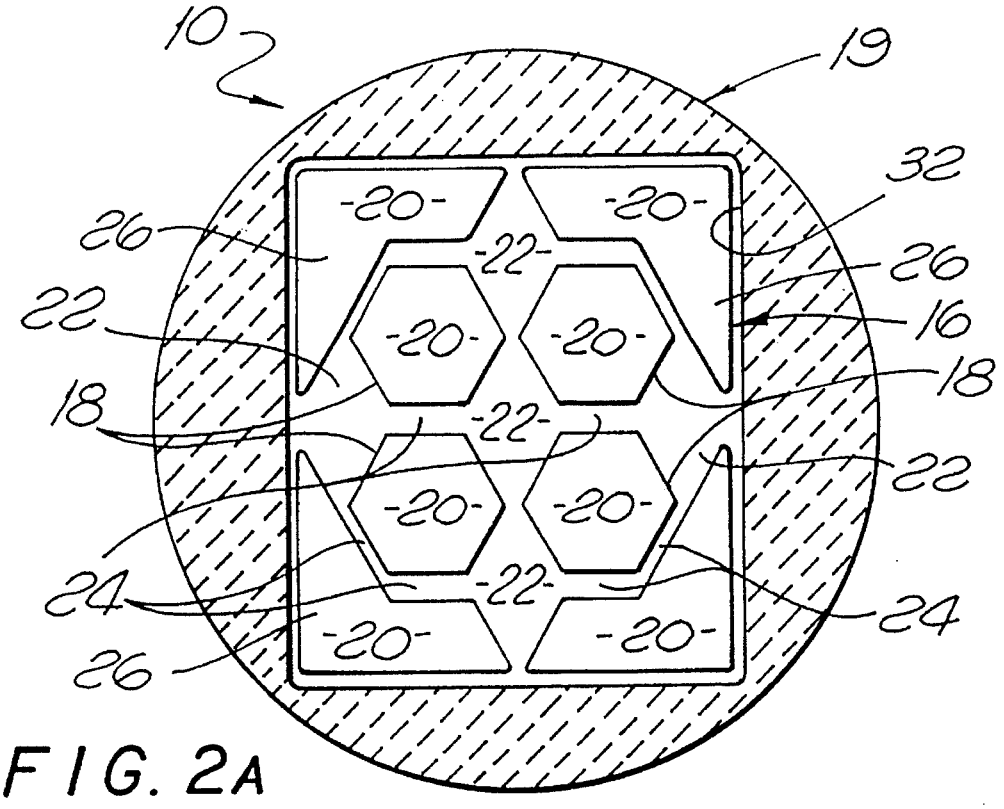
FIG. 2A is a horizontal sectional view of the closing switch of FIG. 1 in the direction 2A—2A of FIG. 1.
Figure 2B:
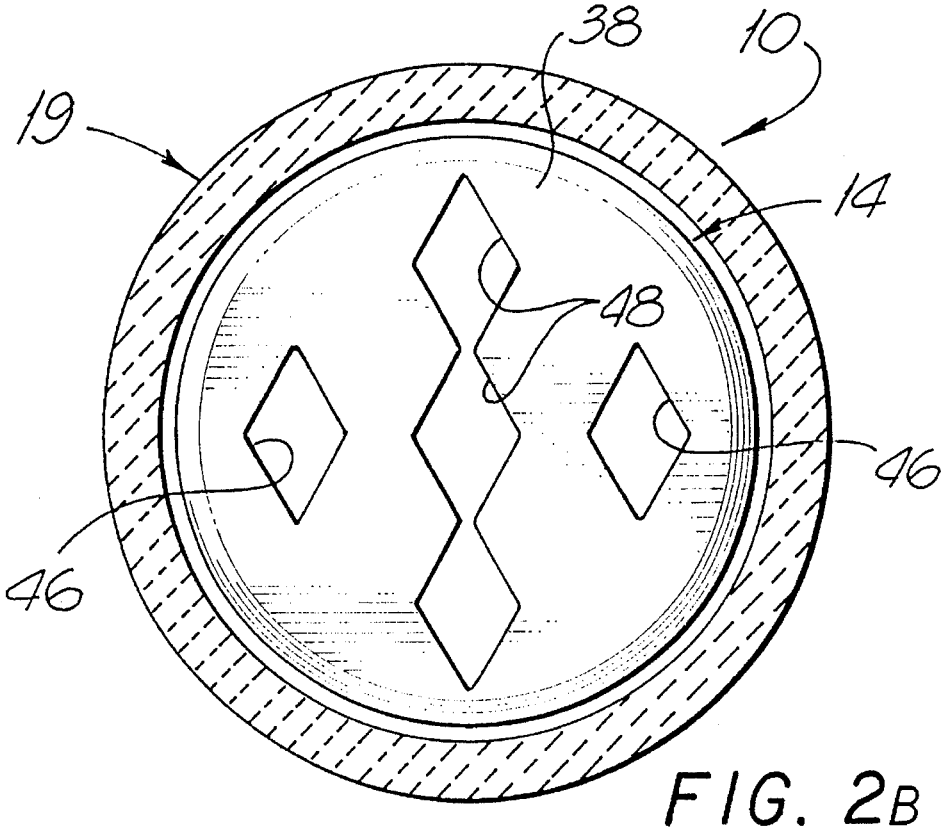
FIG. 2B is a horizontal sectional view taken in the direction 2B—2B of FIG. 1.

In the specific embodiment of FIGS. 2A and 2B, the anode structure 16 also includes a plurality of corner segments 26 which closely surround the anode segments 18 to eliminate undesirable open spaces in the anode region. As seen in FIG. 2A, the anode segments 18 and the corner segments 26 combine to form a composite conductive anode which is substantially rectangular in cross section and has five primary gaps 22 and numerous secondary gaps 24. The anode segments 18 and the corner segments 26 are mounted to an end plate 28 which engages an upper end 30 of the housing 19 of the closing switch 10. The end plate 28 is bonded to the upper end 30 by brazing or other suitable technique to provide a fluid-tight seal. In this configuration, the anode segments 18 and the corner segments 26 are all received within a substantially square anode chamber 32 formed by the housing 19 adjacent its upper end. The anode structure also has a post 34 for connection to a circuit to be switched.

The anode segments 18 and the corner segments 26 are made of a suitable anode material, preferably molybdenum or other refractory metal, and may be either hollow or solid in construction. In one embodiment, these segments are formed from bar stock, the anode segments 18 being machined to form rods of hexagonal cross section and the corner segments 26 being machined to the irregular cross section shown in the drawings. Alternatively, both the anode segments 18 and the corner segments 26 can be formed as hollow bodies or flat surface elements supported by legs or other suitable structure depending from the end plate 28 of the anode. In any of these embodiments, it is the bottom surfaces 20 of the anode segments which hold off the high voltage between the anode and the grid structure, whereas the gaps between the various segments retain ionized gas to facilitate reverse conduction.

Referring specifically to FIGS. 1 and 2B, the control electrode 14 is preferably formed as a deep-drawn cup having cylindrical side walls 36 which join a substantially closed upper end 38 and a transversely directed lower flange 40. The lower flange 40 is bonded to an open lower end 42 of the housing 19 by brazing or other suitable fluid-tight method in the manner described above for the end plate 38, and is rather closely received within the cylindrical cavity 44 of the housing 19 below the anode structure 16.

The upper end 38 of the control electrode 14 preferably contains a plurality of openings corresponding in shape and dimension to the primary gaps 22 of the anode structure 16. In the embodiment of FIGS. 2A and 2B, these openings take the form of a pair of side openings 46 and a central row of openings 48 when viewed in the orientation of FIG. 2B. Each of the openings is shaped as a rhombus, with the openings 48 connected along their common axis. The openings 46 and 48 are thus located directly opposite the areas containing the greatest volume of conducting plasma within the anode structure 16, directing the current of charge carriers specifically toward and away from those regions. It will be understood, however, that additional openings can be provided in the control electrode 14 at locations opposing the secondary gaps 24 of the anode structure 16, if desired. Thus, the control electrode 14 can have a pattern of openings corresponding to both the primary gaps 22 and the secondary gaps 24 of the anode structure 16. In either case, a series of baffles 50 may be provided beneath the openings of the electrode structure 14 to avoid any line-of-sight paths between the anode and the cathode.

The cathode structure 12 comprises a cathode 52 surrounded by a heat shield 54 and supported by a cathode base plate 56 which is brazed to the lower flange 40 of the control electrode to provide a fluid-tight seal at the lower end 42 of the housing. Electrical connection to the cathode 52 and a gas reservoir 58 is made through bushings 60 extending through the cathode base plate 56. A tube 62 also extends through the base plate to evacuate and backfill the interior of the switch 10 during manufacture.

The housing 19 can be fabricated of any suitable dielectric material, but is most often made of either glass or a suitable ceramic. In the specific structure of FIG. 1, the housing is ceramic and is cast to the general configuration shown. It is then machined to required tolerances at it mating surfaces.

Figure 3A:
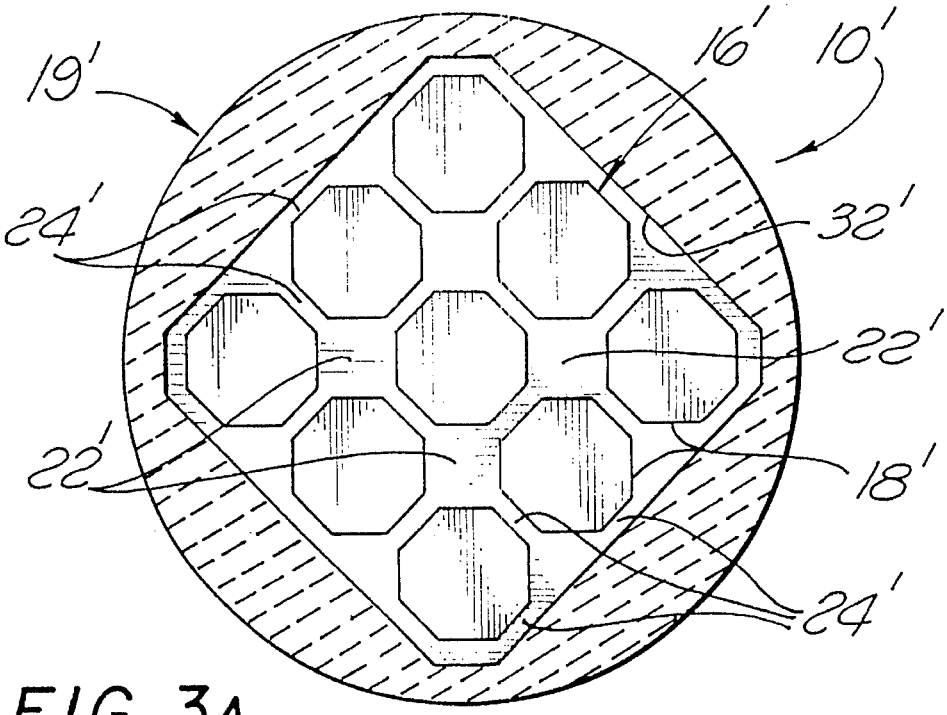
FIG. 3A is a horizontal sectional view corresponding to that of FIG. 2A, but illustrating an alternative embodiment of the present invention.
Figure 3B:
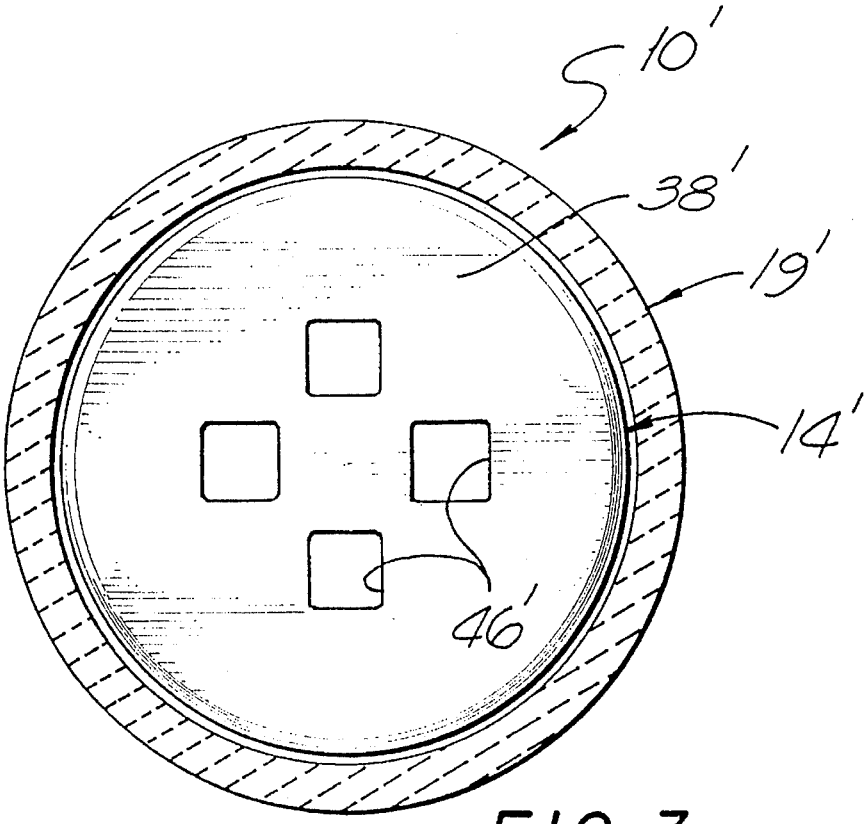
FIG. 3B is a horizontal sectional view which corresponds to the view of FIG. 2B but illustrates the embodiment of FIG. 3A.

An alternative form of the anode structure and the control electrode structure of the closing switch 10 is illustrated in FIGS. 3A and 3B, wherein similar elements are referred to by similar numerals with a "'" added to differentiate them from the corresponding elements of FIGS. 2A and 2B.

Referring first to FIG. 3A, an anode structure 16' contains a plurality of anode segments 18' arranged to provide primary gaps 22' and a number of secondary or "edge" gaps 24' within an anode chamber 32' at the upper end of the housing 19'. As shown in FIG. 3B, a control electrode structure 14' for use with the anode structure 16' has four openings 46' corresponding in location and dimension to the primary gaps 22' of the anode structure. The openings 46' serve the function of the openings 46 and 48 in the control electrode structure 14 of FIG. 2B, and can be augmented by other openings corresponding to the secondary gaps 24' of the anode structure 16', if desired In operation, a high positive voltage is applied to the anode structure 16 or 16' and the cathode structure is grounded. The control electrode structure 14 or 14' is either grounded or maintained at a small negative potential to repel electrons emitted by the cathode structure in the "open" condition of the switch. Substantially all of the voltage across the switch 10 is therefore present between the bottom surfaces of the anode structure 16 or 16' and the control electrode structure 14 or 14' in the open condition, but breakdown does not occur because there are very few free carriers and the spacing between the components is small. When a positive pulse is applied to the control electrode structure 14 or 14', electrons are drawn from the cathode structure, which is preferably coated with a thermionic coating and heated to a temperature of approximately 800° C., to ionize the gas within the housing 18 and create a plasma of highly energized gas species. As the electrons and other charge carriers travel through the gas, they collide with gas molecules and set up an avalanche ionization process which results in a dense conducting plasma throughout the interior of the housing.

The switch 10 returns to its nonconducting state only when the anode voltage is removed for a time sufficient to allow the charged particles of the plasma to recombine. This period is known as the "recovery time" of the device. After the recovery period, the grid potential returns to its original (typically negative) value and a positive voltage can be applied to the anode structure 16 or 16' without conduction taking place. The switch 10 is then ready to fire in response to the next positive control pulse.

In some circumstances, and particularly in laser switching systems having very small inductances and operating at very high frequencies, high inverse voltages can occur between the cathode structure and the anode structure after each forward conduction pulse. The potentially detrimental effects of this voltage are controlled in the structure of the present invention by allowing conduction in the reverse direction due to the ionized gas species existing within the gaps between the various portions of the anode segments. Any reverse current extends into the gaps where the ionized species are believed to lose their momentum to un-ionized gas molecules and ultimately impinge harmlessly on the sides of the anode segments. After recombination of the charged particles of the plasma, the closing switch 10 is ready to fire again.

While certain specific embodiments have been disclosed as typical, the invention is not limited to these particular forms, but rather is applicable broadly to all such variations as fall within the scope of the appended claims. For example, the anode structure of the present invention can take any of a variety of forms so long as it provides a plurality of gaps or spaces capable of containing ionized gas species and thereby facilitating reverse conduction. The invention is also not limited to the thyratron-type closing switch described herein, but rather is suitable for use in any gas discharge closing switch subject to high inverse voltage swings.

What is claimed is:

1. A gas discharge closing switch comprising:

a housing for maintaining a gaseous discharge, said housing having first and second ends;

an anode structure adjacent the first end of said housing, said anode structure comprising a plurality of surface elements connected electrically together and facing substantially toward the second end of the housing, said surface elements being spaced from each other to define gaps therebetween;

a cathode structure adjacent the second end of the housing; and a control electrode structure disposed within the housing between the anode structure and the cathode structure, said control electrode structure defining a plurality of apertures each disposed opposite one of said gaps.

2. The gas discharge closing switch of claim 1 wherein:

the surface elements of the anode structure are disposed along a common plane.

3. The gas discharge closing switch of claim 1 wherein:

the surface elements of the anode structure are polygons.

4. The gas discharge closing switch of claim 1 wherein:

the surface elements are terminal surfaces of discrete segments of the anode structure.

5. The gas discharge closing switch of claim 4 wherein:

the gaps between said surface elements are small enough to inhibit long path discharges between the control electrode and the anode structure.

6. The gas discharge closing switch of claim 4 wherein:

said discrete segments of the anode structure are solid bodies.

7. The gas discharge closing switch of claim 4 wherein:

said discrete segments of the anode structure are hollow bodies.

8. The gas discharge closing switch of claim 1 wherein:

said gaps comprise a plurality of secondary gaps and a plurality of primary gaps; and each of said apertures of the control electrode structure is disposed opposite one of said primary gaps.

9. The gas discharge closing switch of claim 1 wherein:

said secondary gaps are narrower than said primary gaps and are of substantially uniform width.

10. The gas discharge closing switch of claim 8 wherein:

said apertures of said control electrode structure are similar in size and shape to said primary gaps and are disposed opposite to them.

11. A gas discharge closing switch comprising:

a housing for maintaining a gaseous discharge, said housing having upper and lower ends;

an anode structure adjacent the upper end of said housing, said anode structure comprising a plurality of surface elements connected electrically together and facing substantially toward the lower end of the housing, said surface elements being spaced from each other to define gaps therebetween and formed as terminal surfaces of discrete segments of the anode structure, said gaps comprising a plurality of secondary gaps and at least one primary gap;

a cathode structure adjacent the lower end of the housing; and a control electrode structure disposed within the housing between the anode structure and the cathode structure, said control electrode structure comprising a surface defining a plurality of apertures each of which is disposed opposite one of said primary gaps.

* * * * *